US006231384B1

(12) United States Patent
Kuo

(10) Patent No.: US 6,231,384 B1
(45) Date of Patent: May 15, 2001

(54) PANEL MOUNTED CABLE END CONNECTOR

(75) Inventor: Peter Kuo, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,663

(22) Filed: Dec. 29, 1999

(51) Int. Cl.[7] ..... H01R 13/74
(52) U.S. Cl. ..... 439/545; 439/610; 439/939
(58) Field of Search ..... 439/545, 607–610, 439/939, 181

(56) References Cited

U.S. PATENT DOCUMENTS 3,052,865 * 9/1962 Pappano et al. ..... 439/545
5,127,852 * 7/1992 Cravens et al. ..... 439/545
5,772,471 * 6/1998 Buck ..... 439/939
6,033,263 * 3/2000 Weidler et al. ..... 439/939
6,066,001 * 5/2000 Liptak et al. ..... 439/939

* cited by examiner

*Primary Examiner*—Gary F. Paumen
(74) *Attorney, Agent, or Firm*—Wei Te Chung

(57) ABSTRACT

An electrical connector device comprises a cable end connector and a metal panel. The cable end connector comprises a body portion, an insulative housing and a metal frame. The metal frame is electrically conducted between the metal cover and the metal panel for discharging static electricity accumulated on the cable end connector to the metal. The metal frame defines an upper wing and a pair of side wings. Each side wing forms a pair of latches which downwardly extend therefrom for locking with corresponding engaging holes formed in the metal panel. Therefore, the assembling process of attaching the cable end connector to the metal panel is simplified.

1 Claim, 3 Drawing Sheets

PANEL MOUNTED CABLE END CONNECTOR

BACKGROUND OF THE INVENTION

The present invention relates to a panel mounted cable end connector, and particularly to a panel mounted cable end connector having an attaching element for easily assembling to a metal panel.

Taiwan Patent Application No. 77208525 discloses a conventional connector which is assembled to a metal panel by means of a pair of bolts. In this way, the connector can be securely attached to the metal panel. However, while assembling/disassembling the cable end connector to/from the metal panel, it should take a relatively long time to rotate the bolt by using a screwdriver. Thus, the mounting of the connector to the panel is very inconvenient and time inefficient.

Thus, there is need for an improved cable end connector and metal panel so that the connector can be easily assembled to the metal panel.

BRIEF SUMMARY OF THE INVENTION

A main object of the present invention is to provide an electrical connector having an attaching element and a metal panel having a structure complementary to the attaching element for facilitating an assembling of the electrical connector to the metal panel.

To fulfill the above-mentioned object, according to a preferred embodiment of present invention, an electrical connector device comprises a cable end connector and a metal panel. The cable end connector comprises a body portion, an insulative housing and a metal frame. The insulative housing defines a plurality of passageways for receiving a plurality of terminals therein. A metal cover shrouds around the insulative portion to shield EMI (electromagnetic interference). The metal frame is electrically conducted between the metal cover and the metal panel for discharging static electricity accumulated on the cable end connector to the metal panel.

The metal frame defines an opening in central portion. An upper wing of the metal frame extends downwardly from the top edge thereof and a pair of side wings extends inwardly from lateral edges thereof. Each side wing forms a pair of latches which downwardly extend therefrom.

The metal panel defines a receiving opening for receiving the cable end connector. A folded plate is downwardly folded from the top edge of the receiving opening and define an upper channel for receiving the upper wing of the metal frame. A pair of extending plates inwardly extends from the lateral side of the receiving opening to form a pair of channels. Each extending plate forms a pair of engaging holes for locking with the corresponding latches of the side wing. While assembling the cable end connector to the metal panel, the side wings are upwardly inserted into the channels to reach a position wherein the latches lock with the locking holes and the upper wing is received in the upper channel.

Thus, the cable end connector can be easily assembled to the metal panel without any additional tools and the time-consuming operation of rotating bolts.

Other objects, advantages and novel features of the invention will become more apparent from the following detailed description when taken in conjunction with the accompanying drawings.

DETAILED DESCRIPTION OF THE INVENTION

Figure 1:
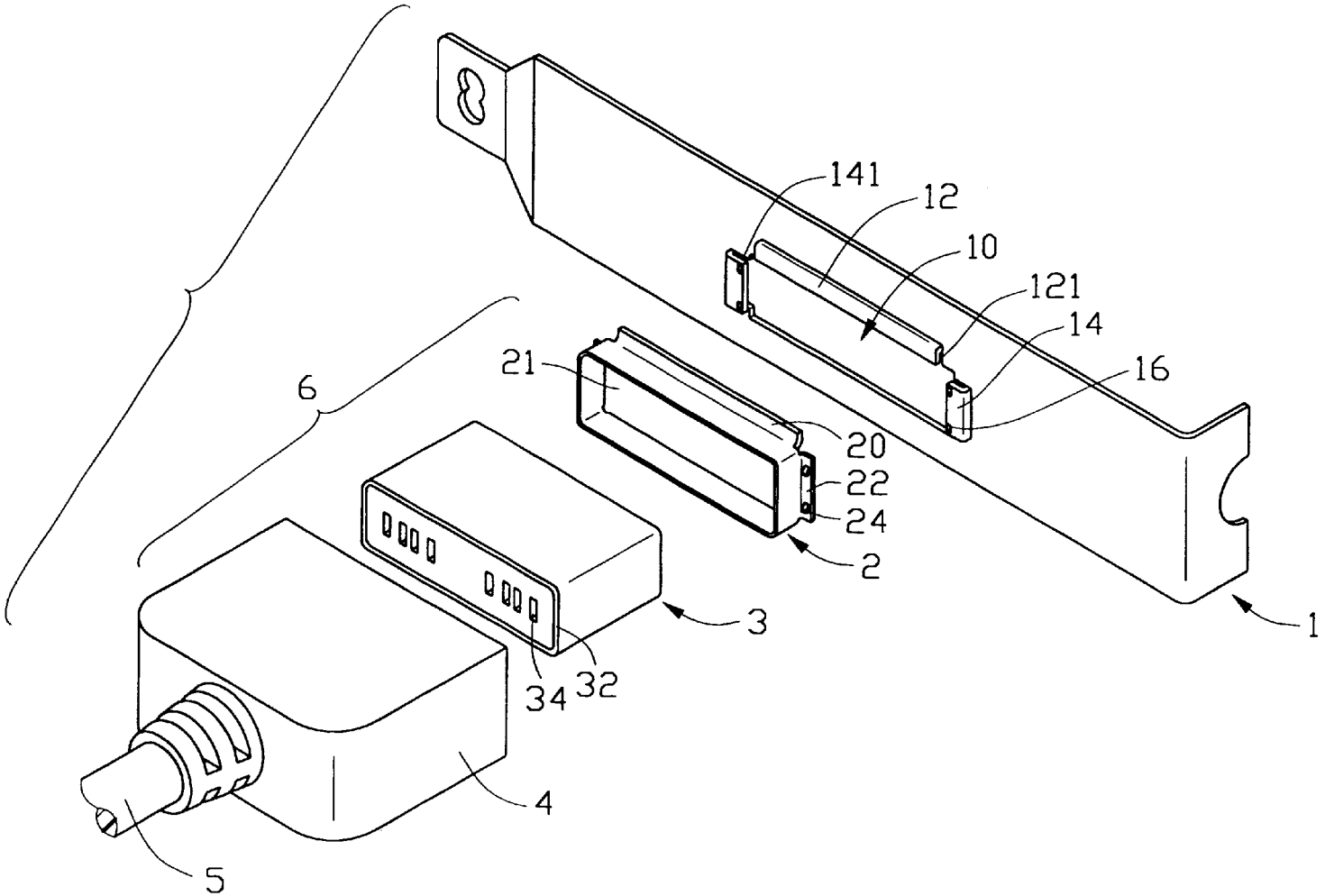
FIG. 1 is a perspective, exploded view of an electrical connector of the present invention and a metal panel.
Figure 2:
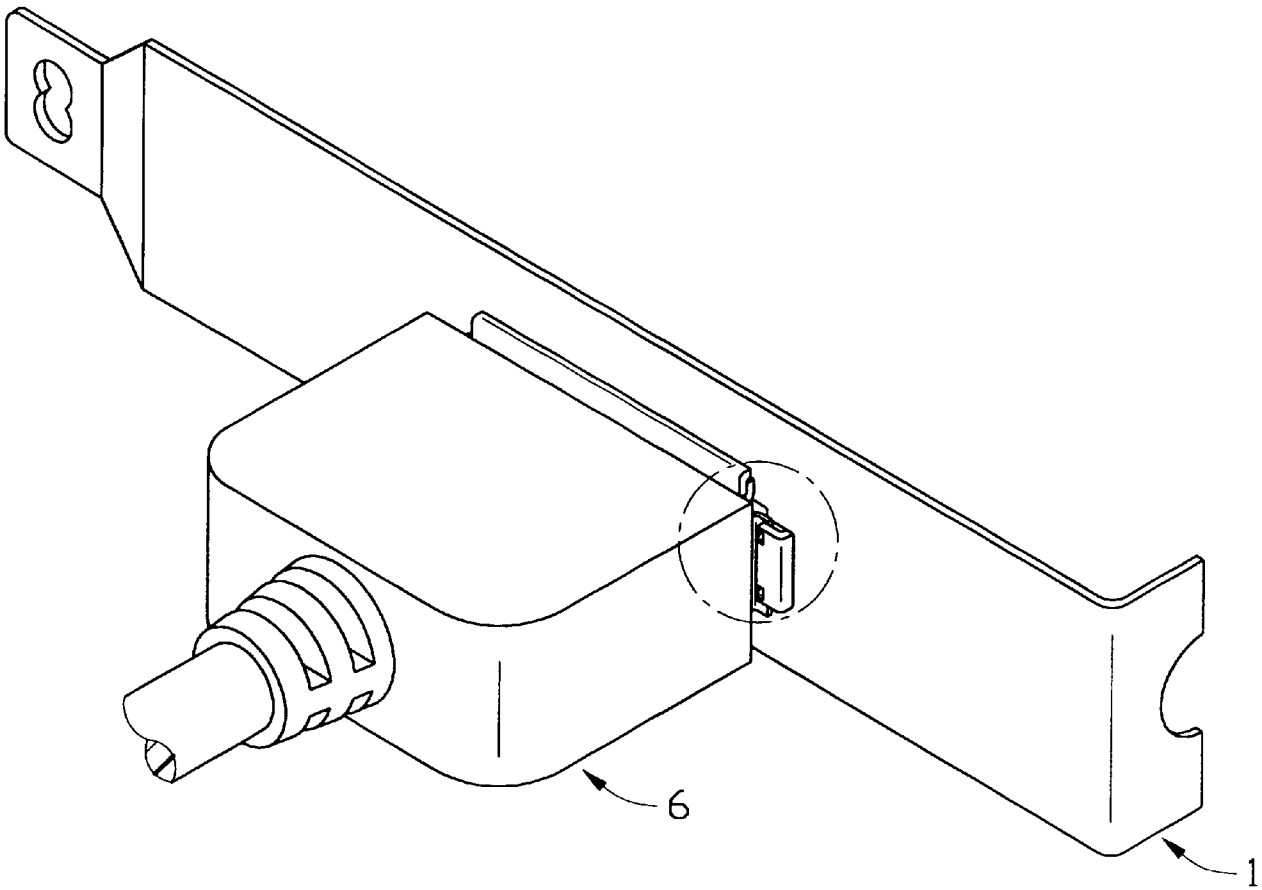
FIG. 2 is a perspective view of the electrical connector assembled with the metal panel.
Figure 3:
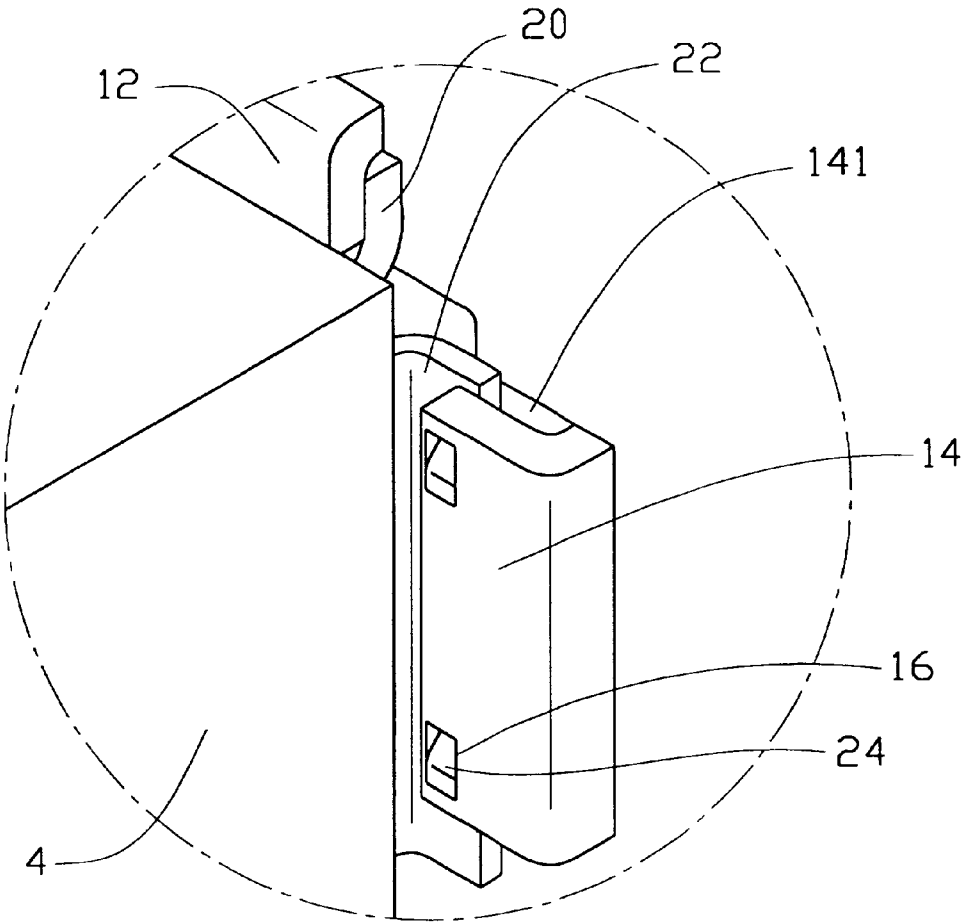
FIG. 3 is a partial, enlarged view of FIG. 2.

Referring to FIGS. 1 to 3, an electrical connector device comprises a cable end connector 6 and a metal panel 1. The cable end connector 6 comprises a body portion 4, an insulative housing 3 and a metal frame 2. The body portion 4 defines a receiving space (not shown) to receive the insulative housing 3 therein. The insulative housing 3 defines a plurality of passageways 34 for receiving a plurality of terminals (not shown) therein, and a metal cover 32 shrouds around the insulative portion 3 to shield EMI. The metal frame 2 is secured to the body portion 4 and surrounds a front portion of a periphery of the insulative housing 3. The metal frame 2 is used for electrically connecting the metal cover 32 and the metal panel 1 for discharging static electricity accumulated on the cable end connector 6 to the metal panel 1.

The metal frame 2 defines an opening 21 in a central portion thereof, and forms an upper wing 20 extending upwardly from a top edge thereof and a pair of side wings 22 extending outwardly from front, lateral edges thereof. Each side wing 22 forms a pair of latches 24 which downwardly extend therefrom.

The metal panel 1 is formed with an elongated body and defines a receiving opening 10 for receiving the cable end connector 6. A folded plate 12 is formed by folding the metal panel 1 to extend downwardly into a top edge of the receiving opening 10. The folded plate 12 defines an upper channel 121 for receiving the upper wing 20 of the metal frame 2. A pair of extending plates 14 is formed by bending the metal plate 1 to inwardly extend near lateral sides of the receiving opening 10. The extending plates 14 forms a pair of channels 141. Each extending plate 14 forms a pair of engaging holes 16 for locking with corresponding latches 24 of the side wing 22. while assembling the cable end connector 6 to the metal panel 1, the side wings 22 are upward inserted into the channels 141 to reach a position wherein the latches 24 lock with the locking holes 16 and the upper wing 20 is received in the upper channel 121. Thus, the cable end connector 6 can be easily assembled to the metal panel 1 without any additional tools and the time-consuming operation of rotating bolts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector device comprising:

a metal panel defining a receiving opening, a pair of extending plates inwardly folded to form two lateral channels at lateral sides of the receiving opening, a folded plate downwardly extending from the top edge of the receiving opening to form an upper channel; and a cable end connector including:

an insulative housing defining a plurality of passageways;

a metal frame securely engaging with the insulative housing, the metal frame having an upper wing extending upwardly from a top edge thereof for being received in the upper channel and a pair of side wings extending outwardly from two lateral edges thereof for being received in the lateral channels; and a body portion securely enclosing the insulative housing and the metal frame;

wherein the metal frame is secured between the body portion and the insulative housing;

wherein a metal cover shrouds the insulative housing for shielding electromagnetic interference;

wherein the metal frame electrically conducts between the metal cover and the metal panel for discharging static electricity accumulated on the cable end connector to the metal panel;

wherein each extending plate of the metal panel defines a pair of engaging holes, and each side wing has a pair of inclinedly projecting latches for engaging with the respective engaging holes.

* * * * *